US008870484B2

(12) United States Patent
Zotalis

(10) Patent No.: US 8,870,484 B2
(45) Date of Patent: Oct. 28, 2014

(54) LIP COLOR AND APPLICATOR CASE

(76) Inventor: Lynne Dianne Zotalis, Decorah, IA (US)

( * ) Notice: Subject to any disclaimer, the term of this patent is extended or adjusted under 35 U.S.C. 154(b) by 681 days.

(21) Appl. No.: 13/187,144

(22) Filed: Jul. 20, 2011

(65) Prior Publication Data

US 2012/0034013 A1 Feb. 9, 2012

Related U.S. Application Data

(60) Provisional application No. 61/400,932, filed on Aug. 5, 2010.

(51) Int. Cl.
*A46B 11/00* (2006.01)
*A45D 40/26* (2006.01)

(52) U.S. Cl.
CPC ..... *A45D 40/264* (2013.01)
USPC ..... 401/126; 401/128; 401/130; 401/122

(58) Field of Classification Search
USPC ..... 401/122, 126, 128–130; 215/317, 321
See application file for complete search history.

(56) References Cited

U.S. PATENT DOCUMENTS 1,463,856 A * 8/1923 Von Allmen ..... 215/321
5,324,128 A * 6/1994 Gueret ..... 401/126
6,149,022 A * 11/2000 Akyildiz et al. ..... 215/222
6,375,375 B1 4/2002 Gebb et al.
6,523,548 B2 * 2/2003 Bouix et al. ..... 401/129
6,682,242 B1 * 1/2004 Montoli ..... 401/126
6,905,277 B2 6/2005 Saito et al.
6,981,814 B2 1/2006 Geardino et al.
7,125,189 B2 10/2006 Gueret
7,448,393 B2 11/2008 Beak
7,927,032 B2 4/2011 Sanchez
D683,902 S * 6/2013 Zotalis ..... D28/76
8,702,333 B2 * 4/2014 Geuther ..... 401/129
2002/0030032 A1 * 3/2002 Roemer ..... 215/317
2005/0100392 A1 5/2005 Chen
2006/0163188 A1 * 7/2006 Lagler ..... 215/235
2006/0239753 A1 * 10/2006 Hrymoc ..... 401/122
2006/0245812 A1 11/2006 Carlino
2010/0018975 A1 1/2010 DeMarco
2010/0183355 A1 7/2010 Pires et al.
2013/0343800 A1 * 12/2013 Drugeon et al. ..... 401/126

FOREIGN PATENT DOCUMENTS

EP 1 427 307 B1 5/2008

* cited by examiner

*Primary Examiner* — David Walczak
*Assistant Examiner* — Bradley Oliver
(74) *Attorney, Agent, or Firm* — Kinney & Lange, P.A.

(57) ABSTRACT

A method for using a lip coloring apparatus includes inserting a lip coloring applicator into a reservoir of lip color and twisting a cap attached to the lip coloring applicator relative to a body containing the reservoir. The method further includes mating a tab of the cap with a cut-out in the body to secure the cap and body to one another.

12 Claims, 3 Drawing Sheets

LIP COLOR AND APPLICATOR CASE

CROSS-REFERENCE TO RELATED APPLICATION(S)

This application claims priority to U.S. Provisional Patent Application No. 61/400,932 filed Aug. 5, 2010.

BACKGROUND

The present disclosure relates generally to cosmetics, and more specifically to a lip color and applicator case.

It is known to store liquid cosmetics (e.g. lip gloss, lip stick, mascara, eye liner, nail varnish, and concealer) in portable containers. Often, the portable container will also include space for transportation of an applicator. Sometimes the applicator is attached to a cap, which has a threaded relationship with the portable container. When the cap is secured to the container, the applicator is stored inside of the container along with the liquid cosmetic. Removal of the cap from the container allows a user to apply the liquid cosmetic by using the exposed applicator.

SUMMARY

A cosmetic apparatus includes a body, a reservoir, a head, and a wand. The body includes a front, a back, a first side, a second side, an enclosed bottom, and an open top forming a container having rounded edges. The first side of the body includes a first cut-out and the second side of the body includes a second cut-out. The reservoir is located within the body adjacent the enclosed bottom and is adapted for containing a liquid cosmetic. The head includes a front, a back, a first side, a second side, an enclosed top, and an open bottom forming a cap having rounded edges. The first side of the head includes a first tab having a mating relationship with the first cut-out and the second side of the head includes a second tab having a mating relationship with the second cut-out. The wand includes a first end attached to an inside of the head and a second end having an applicator for applying the liquid cosmetic. The second end of the wand is secured in the reservoir by the mating relationship between the head and the body.

A lip coloring apparatus includes a container, a reservoir, a center bezel, a cap, and a wand. The container includes a front, a back, a first side, a second side, enclosed bottom, an open top, and curved edges. The first side of the container includes a first cut-out and the second side of the container includes a second cut-out. The reservoir is located within the container adjacent the enclosed bottom and is adapted for containing lip color. The center bezel is received into the container adjacent the open top. The center bezel has a first detent exposed by the first cut-out and a second detent exposed by the second cut-out. The cap includes a front, a back, a first side, a second side, an enclosed top, an open bottom, and curved edges. The first side of the cap includes a first tab having a first protrusion and the second side of the cap includes a second tab having a second protrusion. The wand includes a first end attached to the cap and a second end having an applicator for applying lip color. Insertion of the second end of the wand through the center bezel and into the reservoir draws the first end and attached cap toward the body. Twisting of the cap in relation to the body causes the first protrusion of the first tab to mate with the first detent and first cut-out, and the second protrusion of the second tab to mate with the second detent and the second cut-out.

A method for using a lip coloring apparatus includes inserting a lip coloring applicator into a reservoir of lip color and twisting a cap attached to the lip coloring applicator relative to a body containing the reservoir. The method further includes mating a tab of the cap with a cut-out in the body to secure the cap and body to one another.

DETAILED DESCRIPTION

Figure 1:
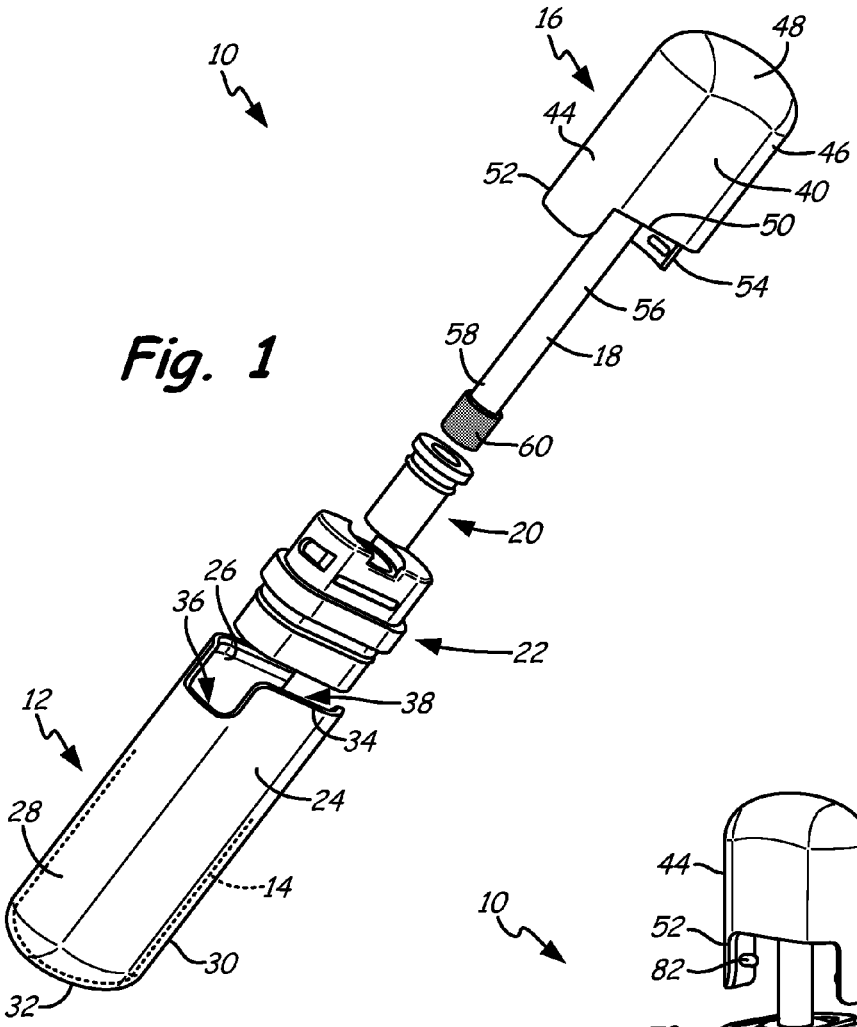
FIG. 1 is an exploded perspective view of a lip coloring apparatus in accordance with the present disclosure.

FIG. 1 is an exploded perspective view of lip coloring apparatus ("LCA") 10 in accordance with the present disclosure. LCA 10 includes body 12, reservoir 14, head 16, wand 18, center bezel 20, and seal 22. Body 12 further includes front 24, back 26, first side 28, second side 30, bottom 32, and top 34. First side 28 of body 12 has first cut-out 36, and second side 30 of body 12 has second cut-out 38. Similar to body 12, head 16 includes front 40, back 42 (not visible), first side 44, second side 46, top 48, and bottom 50. First side 44 of head 16 has first tab 52, and second side 46 of head 16 has second tab 54. Wand 18 includes first end 56 and second end 58 having applicator 60. When assembled, second end 58 of wand 18 is secured inside of reservoir 14 by a mating relationship between body 12 and head 14.

LCA 10 includes body 12 having internal reservoir 14 at a lower end and head 16 at an upper end, which is detached and exploded away from body 12 in FIG. 1. When fully assembled and locked, body 12 and head 16 form a substantially cuboid shape having curved edges (see FIG. 3). Extending downwardly from head 16 and toward body 12 is wand 18. Located beneath wand 18 is seal 20, and located beneath seal 20, but above body 12, is center bezel 22. When assembled, wand 18, seal 20, and center bezel 22 are all received into body 12 (see FIG. 2).

Body 12 includes front 24, back 26, first side 28, second side 30, closed bottom 32 and open top 34, which are all connected by curved edges to from a container for holding internal reservoir 14 (as well as wand 18, seal 20, and center bezel 22 when assembled). As indicated by their names, front 24 is opposite back 26, first side 28 is opposite second side 30, and bottom 32 is opposite top 34. Each portion of body 12 is connected to its adjacent portion by rounded or curved edges, such that body 12 has no sharp corners. Reservoir 14 is located inside of body 12 adjacent bottom 32 and includes a liquid cosmetic such as lip gloss. Reservoir 14 may be plastic and/or replaceable. First side 28 includes first cut-out 36, which extends along a depth of body 12 and is continuous with open top 34. Similarly, second side 30 includes second cut-out 38, which extends along the depth of body 12 and is continuous with open top 34. First cut-out 36 and second cut-out 38 extend downwardly from top 34 into first side 28 and second side 30, respectively. Both first-cut out 36 and second cut-out 38 are approximately square, but have rounded corners and are configured to mate with head 16 (see FIG. 3).

Similar to body 12, head 16 includes front 40, back 42 (not visible), first side 44, second side 46, closed top 48, and open bottom 50, which are all connected by curved edges to from a cap for attaching to body 12. As indicated by their names, front 40 is opposite back 42, first side 44 is opposite second side 46, and top 48 is opposite bottom 50 Like body 12, each portion of head 16 is connected to its adjacent portion by rounded or curved edges, such that head 16 has no sharp corners. First side 44 includes first tab 52, which extends along a depth of head 16 and is continuous with open bottom 50. Similarly, second side 46 includes second tab 54 which extends along the depth of head 16 and is continuous with open bottom 50. First tab 52 and second tab 54 extend downwardly from first side 44 and second side 46, respectively, past a lowermost portion of bottom 50. Both first tab 52 and second tab 54 are approximately square, but have rounded corners. First tab 52 and second tab 54 are configured to mate with first-cut out 36 and second cut-out 38, respectively, in order to couple body 12 with head 16 (see FIG. 3).

Wand 18 is attached to, and extends downwardly from, an inside of cap 18. Wand 18 is cylindrical and includes first end 56, and elongated center, and second end 58. First end 56 of wand 18 extends upwardly past bottom 50 and into the interior of cap 18. Second end 58 of wand 18 extends downwardly toward seal 20, center bezel 22, and body 12. Attached to the most downward portion of second end 58 is applicator 60. Applicator 60 can be a brush, absorbent material, or any other item capable of applying a liquid cosmetic. When assembled and locked, second portion 58 of wand 18, including applicator 60, is inserted through seal 20 and center bezel 22 to reside within reservoir 14 and is moistened with liquid cosmetic. The structure of seal 20 and center bezel 22 are discussed in further detail below with respect to FIG. 2.

Figure 2:
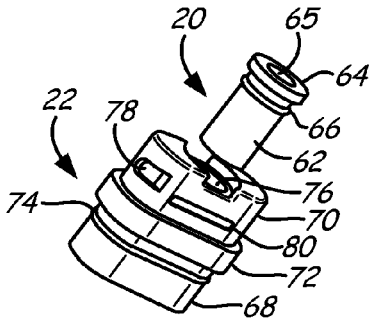
FIG. 2 is an exploded perspective view of a center bezel and a seal from the lip coloring apparatus of FIG. 1.

FIG. 2 is an exploded perspective view of seal 20 and center bezel 22 from FIG. 1. Seal 20 includes cylindrical post 62, lip 64, hole 65, and ring 66. Center bezel 22 includes bottom 68, top 70, shoulder 72, ring 74, hole 76, detents 78, and indentations 80. When assembled, seal 20 is received into center bezel 22, which is received into body 12 (see FIG. 3). Seal 20 prevents liquid cosmetic from leaking out of reservoir 14, and center bezel 22 aids in securing head 16 to body 12.

Seal 20 and center bezel 22 form a central portion of LCA 10 and are located between wand 18 and reservoir 14. Seal 20 has lower and middle portions defined by cylindrical post 62, and an upper portion defined by lip 64. Cylindrical post 62 is hollow and contains central hole 65. Lip 64 is circular, has a slightly larger diameter than cylindrical post 62, and surrounds a top of central hole 65 and cylindrical post 62. Central hole 65 extends continuously through cylindrical post 62 and lip 64, and has a diameter larger than a diameter of wand 18, such that wand 18 can extend through a center of seal 20. Extending around an outer surface of cylindrical post 62 near the point of attachment between lip 64 and cylindrical post 62, is ring 66. Ring 66 encircles post 62 and is slightly raised therefrom to provide an outer surface on seal 20 that can catch or mate with an inner surface of center bezel 22.

Center bezel 22 is generally ovular or elliptical in shape. Lower end 68 is separated from opposite upper end 70 by a central shoulder 72. Lower end 68 and upper end 70 have similar circumferences while shoulder 72 forms a raised band extending outwardly from an outer surface of bezel 20. Extending around the circumference of lower end 68, and parallel to shoulder 72, is ring 74. Similar to ring 66 of seal 20 discussed above, ring 74 forms a raised outer surface on lower portion 68 of center bezel 22 for catching or mating with an inner surface of body 12. Extending through a center of center bezel is hole 76. Hole 76 is slightly larger in diameter than seal 20 and is configured to receive and catch ring 66 of seal 20. Upper end 70 of center bezel 20 further includes two opposite detents 78 (only one is visible). Detents 78 are rectangular-shaped depressions on either side of upper portion 70 and are configured to form a snap-fit lock with head 16 (see FIG. 3). Located on a front and a back of center bezel 20 are elongated indentations 80. Like detents 78, indentations 80 are depressions, but indentations 80 are configured to catch or mate with an inner surface of body 12. Center bezel 22 is received and secured into body 12, and seal 20 is received and secured into center bezel 22, such that wand 18 extends through both seal 20 and center bezel 22 before reaching reservoir 14 (see FIG. 3).

Figure 3:
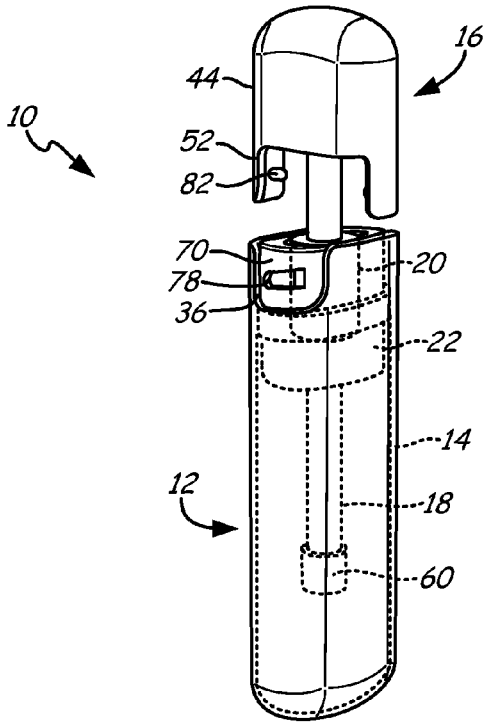
FIG. 3 is an assembled perspective view of the lip coloring apparatus from FIG. 1 in an unlocked position.

FIG. 3 is a perspective view of LCA 10 from FIG. 1 in an assembled and unlocked position. Depicted in FIG. 3 are body 12 and head 16. Components located inside of body 12 and shown in phantom: reservoir 14, wand 18, seal 20, center bezel 22, and applicator 60. First cut-out 36 exposes upper portion 70 and detent 78 of center portion 22, and mating portions of head 16 are identified: first side 44 having first tab 52 with protrusion 82. FIG. 3 shows how cap and body 12 appear when in the unlocked position when applicator 60 of wand 18 is ready for removal from body 12 and use.

As described in detail above with respect to FIGS. 1 and 2, seal 20 is received and secured into center bezel 22, and center bezel 22 is received and secured into body 12. Seal 20 and center bezel 22 reside within body 12 above reservoir 14. Applicator 60 of wand 18 is inserted through center hole (65 in FIG. 2) of seal 20 and down into reservoir 14 in order to absorb or collect a liquid cosmetic. First cut-out 36 of body 12 exposes top portion 70 of center bezel 22 having detent 78. Detent 78 is centrally located within first-cut out. First tab 52 on first side 44 of head 16 is configured to mate and align with first cut-out 36 in order to secure head 16 to body 12. Protrusion 82 is located on an inside surface of first tab 52 and extends inwardly therefrom toward wand 18. Protrusion 82 is configured to snap into and mate with detent 78 in order to secure head 16 to body 12. More specifically, head 16 is twisted or swiveled such that protrusion 82 can slide into, and be received by, detent 78. Concurrent with the mating between protrusion 82 and detent 78, first tab 52 comes to rest within cut-out 36. First tab 52 and protrusion 82, therefore, form a cantilever snap-fit relationship with first cut-out 36, upper portion 70, and detent 78. It should be appreciated that the same mating relationships occur on the opposite, second side 46 of LCA 10, but are not visible. Second tab 54 and protrusion 82 form a cantilever snap-fit relationship with second cut-out 38, which exposes opposite upper portion 70 of center bezel 70 having detent 78. In the depicted embodiment, head 16 is mirrored about a central axis so it can attach to body 12 in either direction (i.e. first tab 52 can mate with second cut-out 38 and second tab 54 can mate with first cut-out 36). In an alternative embodiment, head 16 is directional and will only attach body 12 in one direction (i.e. first tab 52 mates only with first cut-out 36 and second tab 54 mates only with second cut-out 38). The locked configuration of LCA 10 is depicted and described below with respect to FIGS. 4-6.

Figure 4:
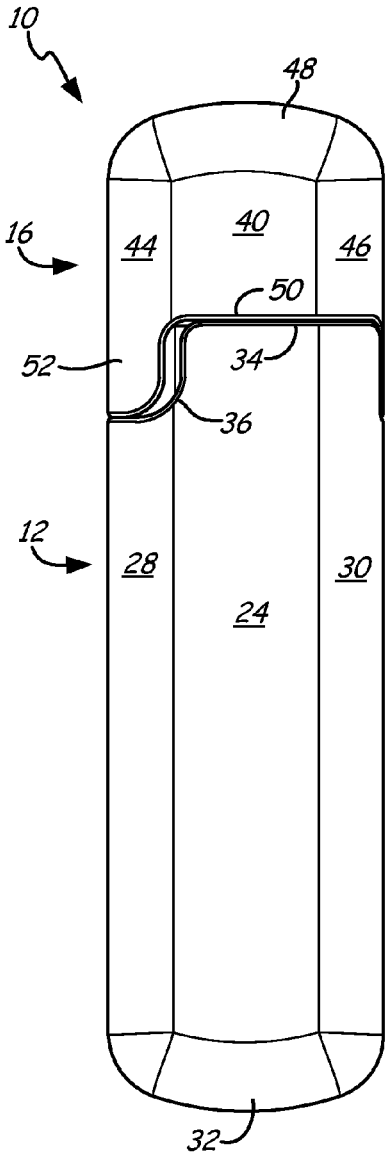
FIG. 4 is a front view of the lip coloring apparatus from FIG. 3 in a locked position.
Figure 5:
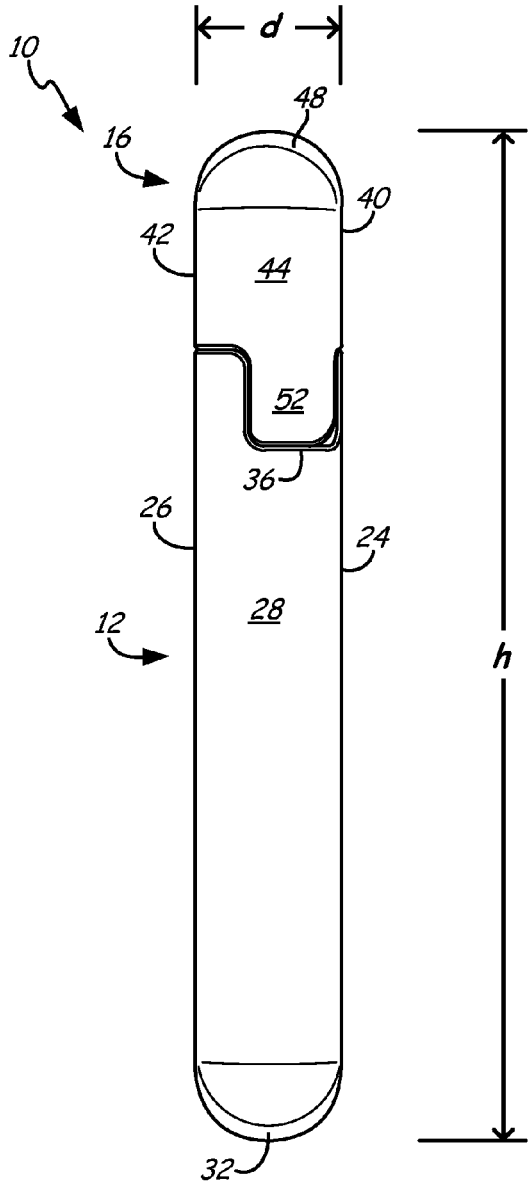
FIG. 5 is a side view of the lip coloring apparatus from FIG. 4 in a locked position.
Figure 6:
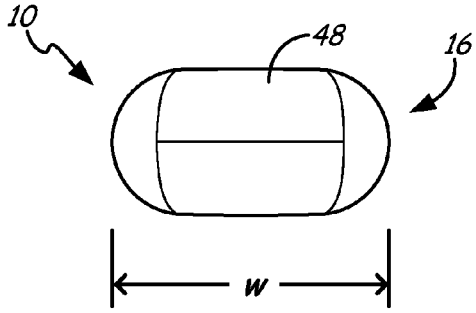
FIG. 6 is a top view of the lip coloring apparatus from FIG. 5.

FIG. 4 is a front view, FIG. 5 is a side view, and FIG. 6 is a top view of LCA 10 from FIG. 3 in a locked position. Shown in FIGS. 4-6 are components of LCA 10: body 12 (having front 24, back 26, first side 28, second side 30, bottom 32, top 34, and first cut-out 36) and head 16 (having front 40, back 42, first side 44, second side 46, top 48, bottom 50, and first tab 52). Also depicted are dimensions height h, depth d, and width w of LCA 10. When assembled and locked, LCA 10 resembles rectangular cuboid having fillet edges.

In FIGS. 4-6, body 12 and head 16 of LCA 10 are joined and locked by the cantilever snap-fit arrangement described above with respect to FIG. 3. Open bottom 50 of cap 16 is adjacent and in contact with open top 34 of body 12. First tab 52 rests within first cut-out 36. Note the space between edges of first tab 52 and first cut-out 36, which allow for rotation of head 16 with respect to body 12, such that head 16 can be unlocked and removed from body 12 (see FIG. 3). Both closed top 48 of cap 46 and closed bottom 32 of body 12 are convex domes. LCA 10 may be formed from bamboo, hemp, plastic, or metal, among other materials.

In the depicted embodiment, LCA 10 has an overall height h between approximately 2 and 4 inches (5.08 cm and 10.16 cm) or more specifically, about 3.128 inches (7.95 cm). Cap 16 is between about one half and one quarter of the overall height of LCA, with body 12 comprising the remaining one half to three quarters height. As shown in FIG. 3, wand 18 has a height, a depth, and a width less than a height, a depth, and a width of body 12, respectively. Both cap 16 and body 12 have depths between approximately 0.2 inches and 0.8 inches (5.08 mm and 2.03 cm) or more specifically, about 0.45 inches (1.14 cm). Both cap 16 and body 12 have widths w between approximately 0.5 inches and 1.0 inches (1.27 cm and 2.54 cm) or more specifically, about 0.85 inches (2.16 cm). Accordingly, cap 16 and body 12 have the same depths d and widths w, but differing heights. In comparison to traditional lip coloring cases, LCA 10 is very streamlined and thin so that it is less visible, or even undetectable, when stored in a clothing pocket or small bag of a user. The curved edges on a six-sided shape of LCA 10 coupled with the fact that LCA 10 is relatively flat (i.e. has little depth d) function to define a discrete portable case for liquid cosmetics and an applicator.

Figure 7:
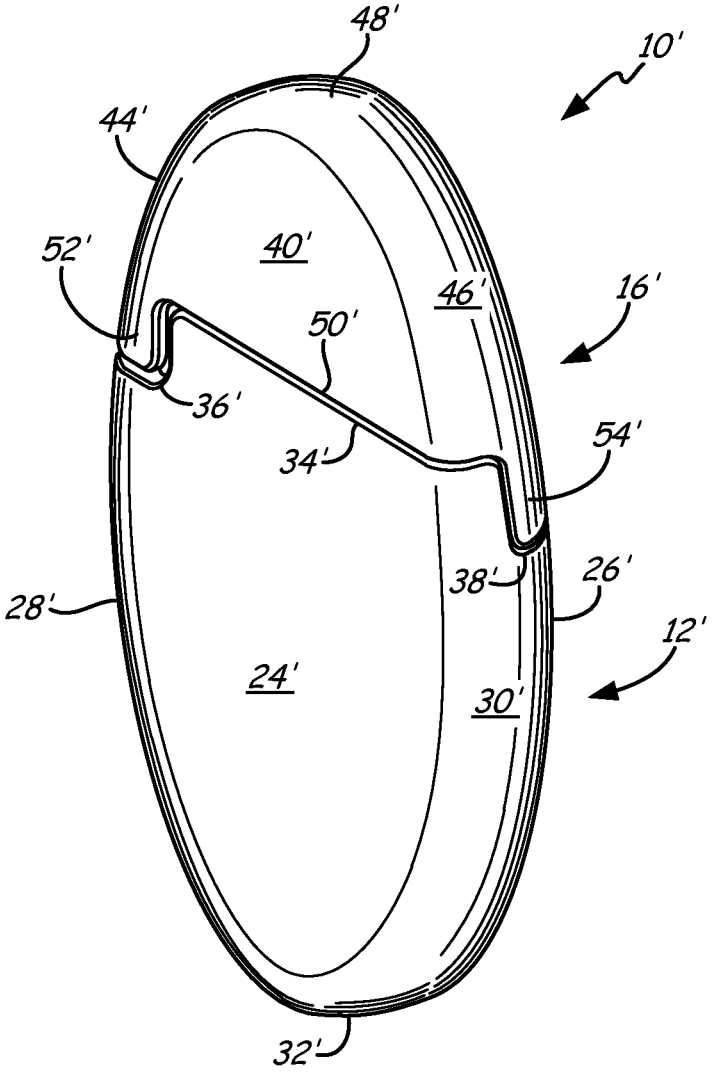
FIG. 7 is a perspective view of an alternative embodiment of a lip coloring apparatus in accordance with the present disclosure.

FIG. 7 is a perspective view of an alternative embodiment of lip coloring apparatus LCA 10' in accordance with the present disclosure. Depicted in FIG. 7 are components of LCA 10': body 12'(including front 24', back 26', first side 28', second side 30', bottom 32', top 34', first cut-out 36', and second cut-out 38') and head 16' (including front 40', back 42', first side 44', second side 46', top 48', bottom 50', first tab 52' and second tab 54'). LCA 10' is similar to LCA 10 described above with reference to FIGS. 1-6 and like numeral designate like components. The components of LCA 10' cooperate and function as described above for LCA 10. The locking mechanisms of LCA 10 and LCA 10' are similar and function to contain a liquid cosmetic inside of reservoir regardless of the orientation of LCA 10 and LCA 10'. The primary difference between LCA 10 and LCA 10' being that LCA 10' is ovoid when assembled and locked. LCA 10' is an alternative embodiment that achieves the same benefits as those described above for LCA 10.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A lip coloring apparatus comprising:

a container including a front, a back, a first side, a second side, enclosed bottom, an open top, and curved edges, wherein the first side includes a first cut-out and the second side includes a second cut-out;

a reservoir for containing lip color located within the container adjacent the enclosed bottom;

a center bezel received into the container adjacent the open top, the center bezel having a first detent exposed by the first cut-out and a second detent exposed by the second cut-out;

a cap including a front, a back, a first side, a second side, an enclosed top, an open bottom, and curved edges, wherein the first side includes a first tab having a first protrusion and the second side includes a second tab having a second protrusion; and a wand including a first end attached to the cap and a second end having an applicator for applying lip color, wherein insertion of the second end through the center bezel and into the reservoir draws the first end and attached cap toward the body, such that twisting of the cap in relation to the body causes the first protrusion of the first tab to mate with the first detent and first cut-out, and the second protrusion of the second tab to mate with the second detent and the second cut-out.

2. The lip coloring apparatus of claim 1, wherein the cap has a cantilever snap-fit relationship with the container.

3. The lip coloring apparatus of claim 1, further comprising:

a seal received into a center of the bezel.

4. The lip coloring apparatus of claim 1, wherein the container and the cap have approximately equal widths and depths, but differing lengths.

5. The lip coloring apparatus of claim 1, wherein the cap has a height less than half of a height of the container.

6. The lip coloring apparatus of claim 1, wherein the container and cap have widths of approximately 0.85 inches and depths of approximately 0.45 inches.

7. The lip coloring apparatus of claim 1, wherein the container and cap form a rectangular cuboid having fillet edges.

8. The lip coloring apparatus of claim 1, wherein the container and cap form an ovoid.

9. The lip coloring apparatus of claim 1, wherein the enclosed bottom of the container is a convex dome and the enclosed top of the cap is a convex dome.

10. A method for using a lip coloring apparatus, the method comprising:

inserting a lip coloring applicator into a reservoir of lip color;

twisting a cap attached to the lip coloring applicator relative to a body containing the reservoir;

mating a tab of the cap with a cut-out in the body to secure the cap and body to one another.

snapping a protrusion on the tab into a detent exposed by the cut-out.

11. The method of claim 10, further comprising:

disengaging the protrusion of the tab from the detent exposed by the cut-out.

12. The method of claim 11, further comprising:

un-mating the tab of the cap with the cut-out in the body;

un-twisting the cap relative to the body; and removing the lip coloring applicator from the reservoir of lip color.

* * * * *

UNITED STATES PATENT AND TRADEMARK OFFICE

CERTIFICATE OF CORRECTION

PATENT NO. : 8,870,484 B2
APPLICATION NO. : 13/187144
DATED : October 28, 2014
INVENTOR(S) : Lynne Dianne Zotalis It is certified that error appears in the above-identified patent and that said Letters Patent is hereby corrected as shown below:

In the Claims

Col. 6, Line 55
Delete "."
Insert --; and--

Signed and Sealed this
Tenth Day of February, 2015

Michelle K. Lee

Michelle K. Lee
*Deputy Director of the United States Patent and Trademark Office*